United States Patent [19]

Tamagawa et al.

[11] Patent Number: 4,659,430

[45] Date of Patent: Apr. 21, 1987

[54] PROCESS FOR MAKING A PHOTOGRAPHIC SUPPORT

[75] Inventors: Shigehisa Tamagawa; Tetsuro Fuchizawa, both of Fujinomiya, Japan

[73] Assignee: Fuji Photo Film Co., Ltd., Japan

[21] Appl. No.: 856,867

[22] Filed: Apr. 24, 1986

Related U.S. Application Data

[63] Continuation of Ser. No. 614,450, May 25, 1984, abandoned, which is a continuation of Ser. No. 435,342, Oct. 19, 1982, abandoned.

[30] Foreign Application Priority Data

Oct. 21, 1981 [JP] Japan ..... 56-168136

[51] Int. Cl.[4] ..... D21H 1/34; D21H 3/10

[52] U.S. Cl. ..... 162/135; 162/158; 162/164.3; 162/179

[58] Field of Search ..... 162/135, 158, 179, 164.3

[56] References Cited

U.S. PATENT DOCUMENTS

| | | | |
|---|---|---|---|
| 3,311,532 | 3/1967 | Kulick et al. | 162/179 |
| 3,755,069 | 8/1973 | Crawford et al. | 162/158 |
| 4,133,688 | 1/1979 | Sack et al. | 162/158 |
| 4,288,287 | 9/1981 | Miyama et al. | 162/158 |

*Primary Examiner*—Peter Chin

*Attorney, Agent, or Firm*—Toren, McGeady and Goldberg

[57] ABSTRACT

A photographic support comprising a paper sheet coated with a polyolefin on both surfaces thereof, in which the paper sheet contains a water-soluble aluminum salt, an unreactive sizing agent, a reactive sizing agent, and optionally a polyamide-polyamine-epichlorohydrin resin, which is particularly resistant to edge soiling.

6 Claims, No Drawings

PROCESS FOR MAKING A PHOTOGRAPHIC SUPPORT

This is a continuation of application Ser. No. 614,450, filed May 25, 1984, now abandoned, which, in turn, is a continuation of application Ser. No. 435,342, filed Oct. 19, 1982 abandoned.

This invention relates to a photographic support, and particularly relates to a water-proof photographic support. More particularly, this invention relates to a water-proof photographic support substantially free from being soiled by a developing solution at the edge portion produced by the cutting procedure.

There has been previously employed, as the photographic support, a baryta paper consisting of a paper coated with a baryta layer comprising mainly barium sulfate on one surface. Recently, however, a water-proof photographic support comprising a paper sheet coated with a hydrophobic polyolefin on both surfaces thereof has been developed and employed to cope with the requirement of a rapid development process with an automation system. At the present time, most of the baryta papers have been replaced with the water-proof photographic support.

Nevertheless, even though the water-proof polyolefin layers are provided to both surfaces, the water-proof photographic support is apt to be soiled by a developing solution at the edge portion produced by the cutting procedure, because the hydrophilic wood pulp fibers constituting the paper sheet are liable to draw the developing solution into the paper sheet from the exposed edge portion. The so-produced edge soiling can be satisfactorily reduced by washing sufficiently the developed photographic paper with water for a long time. However, the washing procedure for a long time is naturally adverse to the requirement for reduction of the development time. For this reason, a measure for preventing permeation of a developing solution from the edge portion has been earnestly studied.

Until now, there is known and generally employed a measure for preventing permeation of a developing solution which involves incorporation of a sizing agent into the paper sheet. However, there necessarily arise various limitations to the sizing agent employable for the purpose, in view of the employment in the specific art of photographic paper. For instance, the sizing agent to be employed should be effective against permeation of either an alkaline or an alcohol such as most generally employed benzyl alcohol, both of which are contained in a developing solution. Moreover, the sizing agent should not decrease whiteness of the photographic paper and should not give any adverse effect to an image produced on the photographic paper such as production of fog. Accordingly, sizing agents generally employable for sizing a paper such as a rosin size and a petroleum resin size are not employable for sizing a paper sheet of the photographic support.

In view of the above-described requirements, there have been proposed a number of specific sizing agents for the use in the photographic support, such as a fatty acid soap sizing agent disclosed in Japanese Patent Publication No. 47(1972)-26,961 and an alkylketene dimer disclosed in Japanese Patent Provisional Publication No. 51(1976)-132,822. These sizing agents, however, are not considered to be satisfactory, because these sizing agents have certain drawbacks. More in detail, the fatty acid soap sizing agent is effective for prevention of permeation of the alcohol, while it is less effective against permeation of the alkaline solution. Moreover, the fatty acid (soap) is liable to be influenced by the quality of water employed in paper making. For instance, the fatty acid soap precipitates in a hard water to impart poor sizing effect to the paper sheet and/or to bring about disadvantageous features in the paper making process. On the other hand, the alkylketene dimer is effective for preventing permeation of an alkaline solution contained in a developing solution, while it is extremely poor in preventing permeation of the alcohol. Moreover, the satisfactory prevention of permeation of the alkaline solution by the alkylketene dimer is accomplished only in the case where a relatively large amount of a preserving agent, that is, a polyamide-polyamine-epichlorohydrin resin is employed together with the alkylketene dimer. Thus, there has not been known a satisfactory sizing agent for the employment in a photographic support.

The object of the invention, accordingly, is to provide a photographic support capable of effectively keeping both an alkaline solution and an alcohol from permeation into the paper sheet, whereby enabling production of a photographic paper substantially free from the edge soiling, that is, substantially free from being soiled by a developing solution at the edge portion.

Another object of the invention is to provide a photographic support that is high in the whiteness and in that the whiteness is maintained even in a long period storage.

A further object of the invention is to provide a photographic support that can be turned into a photographic material substantially free from edge soiling and further free from photographically disadvantageous phenomena such as formation of fog.

A still further object of the invention is to provide an economical photographic support having the improved characteristics such as described above.

Other objects of the invention will be apparent from the content of the specification.

These objects are accomplished by the present invention that is a photographic support comprising a paper sheet coated with a polyolefin on both surfaces thereof, in which the paper sheet contains a water-soluble aluminum salt, an unreactive sizing agent, and a reactive sizing agent. The paper sheet preferably contains further a polyamide-polyamine-epichlorohydrin resin.

One of the characteristic features of the invention resides in the use of a combination of a water-soluble aluminum salt and a reactive sizing agent such as an alkylketene dimer. In this respect, Internal Sizing of Paper and Paperboard (published by Technical Association of the Pulp and Paper Industry, 1971) pp. 164–165 describes that the incorporation of the aluminum salt is detrimental to a paper manufacture employing an alkylketene dimer sizing agent because it results in decrease of the sizing effect. This description has been confirmed by the present inventors, that is, the sizing effect of the alkylketene dimer is extremely reduced when the aluminum salt and the alkylketene dimer are simply combined. It has been now found by the present inventors that incorporation of an unreactive sizing agent such as a higher fatty acid or wax into the combination of an aluminum salt and a reactive sizing agent not only prevent the decrease of the sizing effect, but also effectively induce the advantageous characteristics of the unreactive sizing agent, as well as showing the sizing effect inherently attached to the unreactive sizing agent. This means that the incorporation of the aluminum salt, the unreactive sizing agent and the reactive sizing agent into a paper sheet enables production of a paper sheet very effectively sized against both an alcohol and an alkali contained in a developing agent.

In the invention, the water-soluble aluminum salt preferably is aluminum sulfate or aluminum chloride.

The reactive sizing agent means a sizing agent directly reactive to cellulose material. Examples of the reactive sizing agents include an alkylketene dimer, an alkenylsuccinic anhydride, an isocyanate-aziridine derivative, a succinic acid imide derivative, and a carbonyl derivative. Preferred is an alkylketene dimer having an alkyl group of 8–30 carbon atoms.

The unreactive sizing agent means a sizing agent unreactive directly to cellulose material. Examples of the unreactive sizing agents include a higher fatty acid, its salt, wax such as paraffin wax, microcrystalline wax or ceresine, and a synthetic polymer such as low molecular polyethylene. Preferred is a fatty acid having 12–22 carbon atoms or a salt thereof. Also preferred is wax such as paraffin wax or microcrystalline wax having 10–100 carbon atoms.

The sizing effect provided by the present invention can be further improved by addition of a polyamide-polyamine-epichlorohydrin resin. Accordingly, the combination of a water-soluble aluminum salt, an polyamide-polyamine-epichlorohydrin resin, an unreactive sizing agent and a reactive agent is especially preferred to produce a paper sheet free from the edge soiling.

Moreover, an addition of a cationic sizing agent prepared by the reaction between an aliphatic carboxylic acid and a polyvalent amine introduces more improved sizing effect into the paper sheet. Accordingly, the addition of the cationic sizing agent or replacement of the polyamide-polyamine-epichlorohydrin with the cationic sizing agent is also preferred.

In the invention, the water-soluble aluminum salt is preferably contained in the paper sheet in the amount of 0.5–3.0% by weight based on the amount of the dried pulp of the paper sheet. The unreactive sizing agent is preferably contained in the paper sheet in the amount of 0.5–3.0 % by weight (same basis). The reactive sizing agent is preferably contained in the paper sheet in the amount of 0.2–2.0 % by weight (same basis). The polyamide-polyamine-epichlorohydrin resin is optionally contained in such an amount as 0.2–2.0 % by weight (same basis). The ratio by weight of the unreactive sizing agent against the reactive sizing agent ranges from $\frac{1}{4}$ to 10/1 (unreactive/reactive).

The sizing of a paper sheet with the combination of the aluminum salt, the reactive and unreactive sizing agents, and the optionally employable resin is generally carried out by an internal sizing process. The reactive sizing agent can be optionally applied onto a paper sheet by a surface sizing process. However, the internal sizing process is preferred because the internal sizing process generally produces a very evenly sized structure.

In applying the internal sizing process, the aluminum salt, the reactive and unreactive sizing agents and the optionally employable resin are separately or in combination introduced into a pulp slurry, and then a paper sheet is manufactured from the slurry in a conventional way.

There is no limitation on nature of the pulp constituting the paper sheet, as far as it belongs to those employable in the manufacture of paper sheets for photographic supports. Examples of the pulp materials include cellulose-type pulps such as wood pulps, esparto pulps, and straw pulps. A part of the cellulose-type pulp material can be replaced with a synthetic pulp material.

In the preparation of a paper sheet, it is well known that a variety of additives such as a paper strength increasing agent, a fixing agent, a preserving agent, a filler, a dye and an antistatic agent can be optionally employed. In the present invention, the employment of these additives can be also done, as far as such additives do not bring about adverse effects to the photographic support of the invention. Also permissible is employment of sizing agents other than those specified in the invention, as far as such sizing agents do not produce adverse effects to the photographic support of the invention.

The paper sheet prepared as above is then coated on both surfaces with a polyolefin in a conventional way to prepare a photographic support. A polyolefin generally is polyethylene which is an ethylene homopolymer, or a copolymer of ethylene and one or more of copolymerizable monomers. In the polyethylene copolymer, the copolymerizable monomer preferably amounts to not more than 10 % by weight of the ethylene content. Examples of the copolymerizable monomers include alfaolefins such as propylene and butene-1; vinyl compounds such as styrene, vinyl stearate, vinyl acetate, acrylic acid, methyl acrylate, ethyl acrylate, acrylamide, methacrylic acid, methyl methacrylate, ethyl methacrylate, methacrylamide; and diene compounds such as butadiene and isoprene.

The photographic support of the invention contains, as described above, a water-soluble aluminum salt, an unreactive sizing agent, a reactive sizing agent, and optionally a polyamide-polyamine-epichlorohydrin resin in the paper sheet layer provided between the polyolefin layers. This paper sheet layer is prominently resistant to the permeation of a developing solution comprising both an alkaline and an alcohol. This perminent resistance of the paper sheet layer to both an alkali and an alcohol cannot be accomplished if the paper sheet layer contains only one or two of the above-specified compounds.

For the reasons described above, a photographic material prepared by placing a photographic emulsion layer on the photographic support of the invention shows remarkably reduced edge soiling which is caused in the developing process through permeation of a developing solution from the exposed section face of the paper sheet layer produced, for instance, by cutting, as compared with the conventional photographic materials.

Moreover, a process for the preparation of the photographic support of the invention can be carried out in a relatively simple procedure because pH adjustment of the sizing solution becomes unnecessary. As described hereinbefore, the reactive sizing agent such as an alkylketene dimer cannot be employed in conjunction with an aluminum salt because its sizing effect is extremely decreased. The decrease of the sizing effect is thought to be caused through the presence of the aluminum ion and a low pH condition (lower than pH 6) as produced. Thus, if the alkylketene dimer is employed in conjunction with the aluminum salt on some reasons, the sizing solution containing the aluminum salt has to be adjusted to a higher pH range with an alkali in advance of the incorporation of the alkylketene dimer. Surprisingly, it has been now found that the sizing effect of the reactive sizing agent in the presence of the aluminum ion is enhanced even in such a low pH range as pH 4.0–5.0 if the unreactive sizing agent is introduced thereinto. Accordingly, the adjustment of the pH value of the sizing solution is not required in the preparation of the photographic support of the invention.

The present invention is further illustrated by the following examples, which are by no way intended to restrict the invention.

EXAMPLES (1) Preparation of Test Samples

To an aqueous slurry containing wood pulp fibers (LBKP/NBKP=2/1) beaten to the Canadian freeness level 240 cc. were added successively sodium stearate, aluminum sulfate, polyamide-polyamine-epichlorohydrin resin (Kymene 557, trade mark of DIC-HERCULES Co., Ltd., Japan), and alkylketene dimer having an alkyl group of 14–16 carbon atoms (Aquapel, trade mark of the DIC-HERCULES Co., Ltd.), all in the amounts set forth in Table 1. The pulp slurry was then processed in a conventional way to give a paper sheet of the basis weight 170 g/m$^2$.

One surface (back surface) of the paper sheet was coated with polyethylene of the density of approximately 0.980 g/cm$^3$ to form a coating layer of approximately 0.033 mm thick. Another surface (front surface) of the paper sheet was then coated with polyethylene of the density 0.960 g/cm$^3$ containing titanium dioxide (10% by weight) to form a coating layer of approximately 0.030 mm thick. Thus, water-proof photographic supports (Samples Nos. 1–8) were prepared.

TABLE 1

| Sample No. | Sodium Stearate (amount) | Aluminum Sulfate (amount) | Polyamide-polyamine-epichlorohydrin Resins (amount) | Alkylketene Dimer (amount) |
|---|---|---|---|---|
| 1 | 2.0 wt. % | 1.0 wt. % | 0.5 wt. % | 0 wt. % |
| 2 | 1.5 | 1.0 | 0.5 | 0 |
| 3 | 1.0 | 1.0 | 0.5 | 0.3 |
| 4 | 1.0 | 1.0 | 0.5 | 0.5 |
| 5 | 0.5 | 1.0 | 0.5 | 0.5 |
| 6 | 0 | 0 | 0.5 | 0.7 |
| 7 | 0 | 0 | 0.5 | 1.5 |
| 8 | 0 | 1.0 | 0.5 | 1.5 |

Remark: The amounts are given based on the dried pulp weight.

(2) Evaluation of Test Sample

The eight samples were then subjected to evaluation on the edge soiling liability. The evaluation was carried out by the procedure set forth below.

The photographic support sample was cut to produce a test strip of 8.25 cm wide. The test strip was then developed in Color Paper Automatic Development Apparatus RPV-409 Type (available from Noritu Koki Co., Ltd., Japan) employing a conventional developing solution containing an alkali and benzyl alcohol, and subjected to eye measurement through a magnifying loupe on the depth of the developing solution permeation from the edge section face.

The results of the evaluation are set forth in Table 2.

TABLE 2

| Sample No. | Depth of Developing Solution Permeation |
|---|---|
| 1 | 0.51 mm |
| 2 | 0.63 |
| 3 | 0.30 |
| 4 | 0.22 |
| 5 | 0.29 |
| 6 | 0.60 |
| 7 | 0.48 |
| 8 | 2.40 |

The results set forth in Table 2 clearly indicate that the photographic support of the invention represented by Samples Nos. 3–5 is remarkably improved in the edge soiling liability as compared with the other comparison photographic support samples represented by Samples Nos. 1–2, and Nos. 6–8.

We claim:

1. A process for the preparation of a photographic support having improved edge-soiling properties which comprises:

treating a pulp slurry with a sodium salt of a fatty acid having 12–22 carbon atoms, a water-soluble aluminum salt, and a polyamide-polyamine-epichlorohydrin resin, followed by treatment with an alkylketene dimer having an alkyl group of 8–30 carbon atoms;

preparing a paper sheet from the pulp slurry, said paper sheet containing said water-soluble aluminum salt in the amount of 0.5–3.0% by weight, said polyamide-polyamine-epichlorohydrin resin in the amount of 0.1–2.0% by weight, said salt of a fatty acid in the amount of 0.5–3.0% by weight, and said alkylketene dimer in the amount of 0.2–2.0% by weight, wherein the ratio by weight of the salt of a fatty acid against the alkylketene dimer ranges from $\frac{1}{4}$ to 10/1, all weights being based upon the amount of the dried pulp of the paper sheet; and coating the paper sheet on both sides with a polyolefin resin.

2. The process of claim 1 in which the sodium salt is sodium stearate.

3. The process of claim 1 in which the aluminum salt is sodium aluminate.

4. The process of claim 2 in which the aluminum salt is sodium aluminate.

5. The process of claim 1 in which the alkylketene dimer has 14 to 16 carbon atoms.

6. The process of claim 2 in which the alkylketene dimer has 14 to 16 carbon atoms.

* * * * *